United States Patent [19]

Akiya et al.

[11] Patent Number: 4,758,461

[45] Date of Patent: Jul. 19, 1988

[54] RECORDING PAPER AND INK JET RECORDING METHOD BY USE THEREOF

[75] Inventors: Takashi Akiya, Yokohama; Ryuichi Arai; Mamoru Sakaki, both of Sagamihara; Naoya Morohoshi, Hiratsuka; Megumi Munakata, Atsugi; Masako Saito, Yokohama, all of Japan

[73] Assignee: Canon Kabushiki Kaisha, Tokyo, Japan

[21] Appl. No.: 128,212

[22] Filed: Dec. 3, 1987

[30] Foreign Application Priority Data

| | | | |
|---|---|---|---|
| Dec. 5, 1986 | [JP] | Japan | 61-290247 |
| Dec. 5, 1986 | [JP] | Japan | 61-289019 |
| Dec. 5, 1986 | [JP] | Japan | 61-289020 |
| Dec. 5, 1986 | [JP] | Japan | 61-289021 |
| Nov. 20, 1987 | [JP] | Japan | 62-293579 |

[51] Int. Cl.[4] ..... B41M 5/00

[52] U.S. Cl. ..... 428/212; 346/135.1; 428/195; 428/211; 428/348; 428/537.5

[58] Field of Search ..... 428/195, 211, 212, 337.5, 428/342, 537.5; 346/135.1

[56] References Cited

U.S. PATENT DOCUMENTS

| | | | |
|---|---|---|---|
| 4,478,910 | 10/1984 | Oshima et al. | 427/261 |
| 4,636,410 | 1/1987 | Akiya et al. | 428/331 |

*Primary Examiner*—John E. Kittle
*Assistant Examiner*—P. R. Schwartz
*Attorney, Agent, or Firm*—Fitzpatrick, Cella, Harper & Scinto

[57] ABSTRACT

A recording paper comprises a fibrous substrate paper on the surface of which a silicon containing type pigment and a fibrous material of the substrate paper are present in a mixed state, said recording paper having a Stöckigt sizing degree ranging from 0 to 15 sec. and a basis weight ranging from 90 to 200 g/m$^2$.

12 Claims, No Drawings

RECORDING PAPER AND INK JET RECORDING METHOD BY USE THEREOF

BACKGROUND OF THE INVENTION

1. Field of the Invention

This invention relates to a recording paper useful for ink jet recording, particularly to a recording paper excellent in aqueous-ink absorptivity, resolution of image and color forming characteristic and also to an ink jet recording method by use thereof.

2. Related Background Art

In the prior art, paper for ink jet recording, there have been known:

(1) a recording paper which is prepared by making a paper in general composed mainly of pulp into a sheet with a low sizing degree such as filter paper, blotting paper, etc.;

(2) a recording paper prepared by use of a paper subjected to considerable sizing as the substrate paper, having an ink absorption layer provided thereon by coating of a filler which is porous and large in oil absorption such as silica or zeolite;

(3) a recording paper having a coating layer provided on a substrate paper with low sizing degree as disclosed in Japanese Laid-open Patent Applications Nos. 53012/1977, 11829/1980 and 38087/1984 and U.S. Pat. No. 4,478,910, etc.

In the recording paper (1), although it is excellent in ink absorptivity, ink is penetrates deep into the fibrous layer of the paper and therefore the color forming characteristic of ink is poor. Since the ink is also absorbed along the fibers on the paper surface, there occurs the phenomenon called feathering, whereby there is the drawback that dots become staggered so resolution is lowered to preclude images of good quality.

In the recording paper (2), since the ink absorbing layer is porous and uniform, good dot shapes and resolution can be obtained. However, for imparting sufficient ink absorptivity, the ink absorbing layer must be made thick, and therefore there is also the problem that one coating is insufficient and a plural coatings required.

Further, if the ratio of the pigment to the binder (P/B) in the ink absorbing layer is made too great in order to improve ink absorptivity, the so called powder drop-off by dropping of the pigment may occur, whereby there are involved the drawbacks such that the rollers for paper delivery may slip or that clogging of the ink jet nozzle may occur.

In the recording paper (3), even when a relatively thin coating layer may be provided, there is the advantage that a recording medium with good ink absorptivity and excellent color forming characteristic of the colorant can be obtained as compared with the recording paper (2). However, as a recording system with higher resolution and attachment density of ink is demanded, the ink absorptivity may be sufficient when the recording paper (3) is applied for such a system, but a large amount of ink will penetrate into the substrate paper, whereby color forming characteristic of the colorant and resolution will be lowered. Thus, it is difficult to satisfy both ink absorptivity and these characteristics.

Further, problems called cockling in which pulp fibers are swelled with ink and the printing portion is deformed in wavy form or the so called back-through in which ink reaches the back surface of the paper not only impair quality of recorded image, but cockling will give rise to scraping between the recording paper and the head to impair images, and also back-through may cause back transfer when a recording paper is superposed on another recording paper.

These phenomena are problems inherent in the recording paper (3) which as a whole receives ink, and have appeared particularly as the image with high resolution by ink jet recording is demanded. However, although the above problems are inherent in the recording paper (3), no detailed investigation has been made thereabout.

SUMMARY OF THE INVENTION

Accordingly, an object of the present invention is to provide a recording paper which is minimal powder drop-off, can be produced with relatively low cost and is also excellent in ink absorptivity and color forming property.

Further, another object of the present invention is to provide a recording paper which is suitable for providing highly precise images without problems such as cockling or back-through at the printed portion.

In accordance with the present invention, there is provided a recording paper comprising a fibrous substrate paper on the surface of which a silicon containing type pigment and a fibrous material of the substrate paper are present in a mixted state, said recording paper having a Stöckigt sizing degree ranging from 0 to 15 sec. and a basis weight ranging from 90 to 200 g/m$^2$.

The present invention also provide a recording paper comprising a fibrous substrate paper on the surface of which a coating liquid containing a silicon containing type pigment and an aqueous binder at a weight ratio of 1/1–3/1 is coated, and on the surface of which a silicon containing type pigment and a fibrous material of the substrate paper are present in a mixed state, said recording paper having a Stöckigt sizing degree ranging from 0 to 15 sec. and a basis weight ranging from 90 to 200 g/m$^2$.

Further, the present invention provides an ink jet recording method, which comprises impinging aqueous ink droplets onto a recording medium, said recording medium comprising a fibrous substrate paper on the surface of which a silicon containing type pigment and a fibrous material of the substrate paper are present in a mixed state, said recording medium having Stöckigt sizing degree ranging from 0 to 15 sec. and a basis weight ranging from 90 to 200 g/m$^2$.

DETAILED DESCRIPTION OF THE PREFERRED EMBODIMENTS

Next, to describe in detail the present invention, the substrate paper to be used in the present invention is a sheet containing fibrous material and, if necessary, a pigment, having a Stöckigt sizing degree according to JIS P8122 in the range of 0 to 15 sec. (based on the basis weight of 65 g/m$^2$), and any paper made to a sizing degree of 0 to 15 sec. by a suitable sizing agent according to the acidic sheet making method or the neutral sheet making method known in the art can be used. In regards of ink absorptivity of the recording paper obtained, the sizing degree of the substrate paper should be preferably in the range of 0 to 10 sec., more preferably in the range of 0 to 5 sec. Also, in regards of coating stability of the coating liquid, it is preferably one sec. or more.

Also, for accomplishing the desired object of the present invention, the basis weight of the above paper is also an important factor. More specifically, the basis weight of the substrate paper to be used in the present invention is required to be within the range of 80 to 200 g/m$^2$. If the basis weight is less than the above range, the so called stiffness of the recording paper is weak to pose a problem in carriage characteristic within the printer during printing, and also to lack ink absorption capacity as the recording paper, and therefore the printing portion causes cockling so that sharpness of the image is lowered. Also, when recording is performed by use of a printer having a plural number of recording heads, the convex portion formed by cockling will contact the head during recording, whereby clogging of the head, etc. may be caused to involve the problem that irregularity may be formed in the image obtained.

Further, due to low ink receiving capacity, the ink not received will be subject to back-through, whereby there may be caused the problem that the ink image of the upper recording paper may be back transferred to the image of the lower recording paper when printed matters are placed as superposed on one another, or there may occur the problem that no recording can be performed on the back surface, etc.

On the other hand, if the basis weight exceeds the above range, since the stress applied to the coating layer on the surface increases during bending of the recording paper obtained, whereby problems such as cracking, powder drop-off or peel-off, etc. of the coating layer may be caused.

More specifically, during the coating step, by restreching and bending along the rolls of the coating machine, crack may form on the coating layer surface, which will later cause image irregularity or powder drop-off. Further, during cutting or storage after manufacturing of the recording paper, there is also the problem that similar drop-off is liable to occur during mounting on the printer or in the printer carriage system. Particularly, powder drop-off which occurs during recording is undesirable, because clogging of the recording head may result. Also, it is not preferable to make thickner the thickness of a substrate paper with large stretching and shrinkage degree relative to humidity, because the problem of curling may result.

The various problems as described above can be solved by employment of a substrate paper with a basis weight of 80 to 200 g/m$^2$.

The thickness of the substrate paper to be used in the present invention may be preferably in the range of 50 to 250 $\mu$m. If the thickness is less than the above range, the so called stiffness of the recording paper obtained is weak, posing a problem in conveyance within the printer during printing and also lacking ink absorption capacity, whereby the printing portion causes cockling to ensure the problem that sharpness of the image is lowered.

The fibrous material constituting the above substrate paper to be used in the present invention is composed mainly of wood pulp, typically LBKP and NBKP, but various synthetic fibers or glass fibers may be mixed, if necessary.

The aqueous coating liquid to be used in the present invention comprises primarily a silicon containing type pigment and an aqueous binder. The silicon containing pigment is hydrophilic and provides relatively great oil absorption according to JIS K 5101 in aspect of ink absorptivity and color forming property of the colorant, including for example silica, calcium silicate, aluminum silicate, magnesium silicate and the like. Among them, those with oil absorption of 80 to 300 ml/100 g, more preferably 150 to 250 ml/100 g, are preferred.

The above silicon containing type pigment should be preferably one in which all the particles have the above oil absorption, but the pigment is not necessarily constituted of all the particles having uniform oil absorption, and it may also be a mixture of pigment with different oil absorptions. In the case of such a mixture of pigments with different oil absorptions, 60% by weight or more of the whole pigment may have the oil absorption within the above range.

When the oil absorption of the pigment according to JIS K5101 is less than 80 ml/100 g, the ink absorptivity when incorporated into a recording paper is poor, and the colorant in the ink on the surface of the coated layer cannot be ensured, whereby there is the tendency such that the ink may penetrate deep into the recording paper to make color formation poor. On the other hand, when it exceeds 300 ml/100 g, powder drop-off will occur at the same level of binder and, if a binder necessary for prevention of powder drop-off is employed, lowering in ink absorptivity will be undesirably brought about.

As the aqueous binder, there may be used, for example, one or a mixture of two or more kinds selected from water-soluble polymers such as polyvinyl alcohol, starch, oxidized starch, cationized starch, casein, carboxymethyl cellulose, gelatin, hydroxyethyl cellulose, etc. and water-dispersed polymers such as SBR latex, MBR latex, vinyl acetate emulsion, etc.

The present inventors have studied the characteristics of the aqueous coating liquid during coating, and consequently found that a recording paper having good ink jet recording characteristics can always be obtained stably when the liquid viscosity of the aqueous coating liquid at 30° C. is in the range of 60 to 200 cps.

The viscosity in the present invention is measured under the condition of 60 r.p.m. by B-type viscometer, and thixotropic characteristic, dilatant characteristic, etc. can be also evaluated by changing the rotational number.

If the viscosity of the aqueous coating liquid is less than 60 cps. the aqueous coating liquid will be penetrated deep into the substrate paper to fill the voids possessed by the substrate paper for absorption of ink, with the result that lowered ink absorptivity may occur.

On the other hand, if the viscosity exceeds 200 cps, coating irregularity may be undesirably caused. Also, only water in the aqueous coating liquid is absorbed by the substrate paper to lower the strength of the surface layer, whereby powder drop-off, etc. may occur.

The viscosity of the aqueous coating liquid as described above can be controlled easily by the kinds of the above pigment and binder, combination thereof, their proportions used, the respective concentrations and the total concentration of the both, etc. In the present invention, the ratio of the silicon containing pigment to the binder used may be generally in the range of 3/1 to 1/1 (weight ratio), and an aqueous coating liquid with the total solid content ranging from about 3 to 70% by weight is preferred.

If the binder amount is more than the above range, ink absorptivity, particularly initial absorption speed of ink will be lowered. This problem is pronounced as the sizing degree of the substrtate paper is higher even within the sizing degree of 0 to 15 sec. and the basis weight is lower. On the other hand, if the content of the pigment is larger than the above range, there ensues the problem of powder drop-off due to shortage in adhesive force even when a thin coating layer may be provided. Particularly, in the present invention where a substrate with low sizing degree and high basis weight is used, since the binder in the coating liquid will be readily absorbed by the substrate paper, it is essentially required that the proportion of the pigment should not exceed the above range. The problem of powder drop-off is more pronounced, particularly as the sizing degree of the substrate paper is lower.

Further, the viscosity of the above aqueous coating liquid is also intimately correlated with the coating speed. More specifically, the above aqueous coating liquid comprising a filler which is hydrophilic and has an oil absorption of 80 to 300 ml/100 g according to JIS K5101 and an aqueous binder frequently exhibits thixotropic viscosity like coating liquids in general.

Accordingly, if the coating speed is too quick, coating irregularity will be liable to occur even if the viscosity may be lower, while if it is too slow, the time required for scraping off the coating liquid to a given coated amount after coating is too long, whereby the aqueous coating liquid will be penetrated deep into the substrate to lower undesirably ink absorptivity. Therefore, as the balance between the viscosity of the aqueous coating liquid and the coating speed, the coating speed may be preferably 60 to 200 m/min. when the viscosity is 60 to 200 cps. A coating speed quicker or slower than this range is not desirable, because various problems as described above will occur.

As the coating machine to be used in the present invention, all known in the art may be used, but the coater suitably used in the present invention may include an air knife coater and a bar coater, etc.

The mount of the aqueous coating liquid coated may be suitably within the range of 2 to 10 g/m$^2$ as the coated amount on drying and, if it is less than 2 g/m$^2$, the coating will not function as the coated layer. In other words, when the coated amount is less than 2 g/m$^2$, the ink colliding against the recording surface will be feathered along the fibers to be disturbed in dot shape, and at the same time the dye will be penetrated deep into the inner portion of the paper, whereby coloring density of the image will be lowered. On other hand, if the coated amount exceeds 10 g/m$^2$, the merit of making the sizing degree of the substrate paper 0 to 15 sec. will be lost, and also there exists no more fibrous material of the substrate paper on the recording paper surface, whereby ink absorptivity, color forming characteristic, etc. become unsatisfactory and also feeling as the paper is lowered, also with attendant problem of powder drop-off.

In the present invention, after coating of the aqueous coating liquid under the condition in the present invention, the recording paper is dried according to method known in the art such as drying by hot air drying furnace, drying drum, etc. to provide a recording paper. As an additional step, surface smoothening by super calendaring may be also performed.

As described above, the recording paper of the present invention having a Stöckigt sizing degree of 0 to 15 sec. and a basis weight of 90 to 200 g/m$^2$ is obtained, but more preferably the Stöckigt sizing degree is in the range of 0 to 10 sec., optimally 0 to 5 sec. and the preferable range of the basis weight is in the range of 90 to 160 g/m$^2$.

If the Stöckigt sizing degree of the recording paper exceeds 15 sec., ink absorptivity, particularly initial absorptivity will undesirably lowered.

When the basis weight of the recording paper is less than 90 g/m$^2$, the stiffness of the recording paper obtained is weak to pose a problem in carriage characteristic and or lack ink absorption capacity as the recording paper, whereby the printing portion may cause cockling or back-through, thus causing various problems as described above.

If the basis weight exceeds 200 g/m$^2$, there is involved the problem of powder drop-off or the problem of curling in the recording paper obtained.

The recording paper of the present invention, which contains a large amount of a silicon containing type pigment with high ink absorbing capacity in the surface layer of the recording paper, has high probability of the ink droplets being trapped and absorbed by the pigment, and therefore feathering and diffusion of the ink can be inhibited, whereby it may be considered that dot shape is improved and also the coloring density enhanced.

Also, since the substrate paper itself has ink absorptivity, the ink can be rapidly absorbed into the recording paper, whereby there is not such phenomenon such as flow-out or feathering of ink even when inks with different colors may be attached on one site within a short time, and therefore recorded images with excellent color forming characteristic can be obtained.

Further, in the range of the coating amount in the recording paper of the present invention, the fibrous material on the surface of the substrate paper will not be completely covered with the silicon containing type pigment in the aqueous coating liquid, and the recording paper surface is under the state where the silicon containing type pigment and the fibrous material are mixed with each other. For this reason, not only the recording paper has the sufficient characteristics as the ink jet recording paper, but also it has a texture approximate to plain paper with little powder drop-off from the coated layer as additional advantage.

The present invention is described in more detail by referring to Examples and Comparative examples. In the sentences, parts and % are based on weight unless otherwise particularly noted.

EXAMPLES 1-5, COMPARATIVE EXAMPLES 1-5

As the substrate paper, a hand-made sheet with low sizing degree was controlled to the basis weight as shown below, and to the substrate paper was applied by coating an aqueous coating liquid with the following composition at the coating amounts on drying, respectively, followed by drying at 120° C. for 5 minutes, to obtain recording media of the present invention and for comparative purpose. The basis weight of the substrate paper, coating amounts on drying of coating layers, the basis weights of recording media and Stöckigt sizing degrees of recording media are shown in Table 1.

(Coating liquid composition)

| | |
|---|---|
| Synthetic silica (Syloid 620, produced by Fuji Davison Chemical Ltd.) | 10 parts |
| Polyvinyl alcohol (PVA-117), produced by Kuraray) | 4 parts |
| Water | 100 parts |

COMPARATIVE EXAMPLE 6

As an example of the recording paper (2) as described in the Description of the Related Art, a wood free paper with a basis weight of 80 g/m$^2$, was coated with the above coating liquid at a coating amount on drying of 6 g/m$^2$, dried similarly as above to obtain a recording medium K for comparison. The recording medium obtained has a Stöckigt sizing degree of 25 sec.

TABLE 1

| Sample No. | Basis weight of Substrate Paper | Amount of Coating on Coating Layer | Basis weight of Recording Paper | Stockigt Sizing Degree of Recording Paper |
|---|---|---|---|---|
| A | 40 g/m$^2$ | 6 g/m$^2$ | 46 g/m$^2$ | 4 sec. (Comparative example 1) |
| B | 63 | 2 | 65 | 4 sec. (Comparative example 2) |
| C | 63 | 6 | 69 | 4 sec. (Comparative example 3) |
| D | 85 | 2 | 87 | 4 sec. (Comparative example 4) |
| E | 85 | 6 | 91 | 4 sec. (Example 1) |
| F | 110 | 2 | 112 | 4 sec. (Example 2) |
| G | 110 | 6 | 116 | 5 sec. (Example 3) |
| H | 150 | 2 | 152 | 5 sec. (Example 4) |
| I | 150 | 6 | 156 | 5 sec. (Example 5) |
| J | 400 | 6 | 406 | 6 sec. (Comparative example 5) |

The ink jet recording adaptability of each of the above recording papers A–K are evaluated for ink absorptivity, resolution and color forming characteristic by performing ink jet recording with the use of inks having the compositions shown below by means of an ink jet printer having ink jet heads with four colors of Y, M, C, BK each provided with 128 nozzles at nozzle interval of 1/16 mm(16 nozzles per 1 mm).

Y (yellow) ink composition

| | |
|---|---|
| C.I. Direct Yellow 86 | 2 parts |
| Glycerine | 15 parts |
| Diethylene glycol | 15 parts |
| Water | 70 parts |

M (magenta) ink composition

| | |
|---|---|
| C.I. Acid Red 35 | 2 parts |
| Glycerine | 15 parts |
| Diethylene glycol | 15 parts |
| Water | 70 parts |

C (cyan) ink composition

| | |
|---|---|
| C.I. Direct Blue 199 | 2 parts |
| Glycerine | 15 parts |
| Diethylene glycol | 15 parts |
| Water | 70 parts |

BK (black) ink composition

| | |
|---|---|
| C.I. Food Black 2 | 2 parts |
| Glycerine | 15 parts |
| Diethylene glycol | 15 parts |
| Water | 70 parts |

Evaluation items (1) Dot density was measured for black dots by means of Sakura Microdensitometer PDM-5 (produced by Knoishiroku Photo Industry K.K.) by applying JIS K 7505 to printing microdot.

(2) Ink absorptivity was evaluated by means of a bubble jet system printer having ink jet recording heads of four colors of Y, M, C and BK each provided with 128 nozzles at nozzle interval of 1/16 mm. One with a line being much bolder at the mixed portion of two color inks of the recorded image than at the monochromatic portion was rated as X, one with occurrence of feathering, etc. at the color mixed portion and unclear edge as Δ, one with clear edge also at the mixed color portion similarly to at the monochromatic portion as O.

(3) For powder drop-off, one which gave paper powder attached to finger when the coating layer surface was touched with finger and one which gives rise to paper powder through peel-off or cracking of the coated layer when the recording paper was folded were rated as x, and one which is not so as O.

(4) For back-through, one in which back-through was confirmed during printing by the same printer as in (2) was rated as x, one which was not so as O, and the middle range as Δ.

(5) For cockling, one having scraping generated on the recording paper surface through cockling with head was rated as x, one without generation of scraping but with cockling being confirmed by visual observation and inferior in image quality as Δ, and one without noticeable cockling as O.

The evaluation results are shown in Table 2.

TABLE 2

| Sample No. | (1) Dot density | (2) Ink absorp-tivity | (3) Powder drop-off | (4) Back-through | (5) Cockling | (6) Over-all evalua-tion |
|---|---|---|---|---|---|---|
| A | 1.1 | Δ | O | X | X | X |
| B | 1.1 | Δ | O | X | X | X |
| C | 1.2 | O | O | X | Δ | X |
| D | 1.1 | O | O | Δ | Δ | X |
| E | 1.2 | O | O | O | O | O |
| F | 1.1 | O | O | O | O | O |
| G | 1.2 | O | O | O | O | O |
| H | 1.1 | O | O | O | O | O |
| I | 1.2 | O | O | O | O | O |
| J | 1.2 | O | X | O | O | X |
| K | 1.0 | X | O | O | O | X |

EXAMPLES 6–9

On the substrate paper used in Example 1, the compositions shown below were used, following otherwise the same procedure as in Example 1, recording media L and M of the present invention were obtained. Similarly, according to the same procedure as in Example 3 except for using the compositions shown below on the same substrate paper used in Example 3, recording media N and O of the present invention were obtained. Then, by use of these recording media, recording was performed in the same manner as in Example 1 and evaluation was performed. The results are shown in Table 3.

| | Example 6 L | Example 7 M | Example 8 N | Example 9 O |
|---|---|---|---|---|
| Silica (Syloid 620 | 8 | 7 | 8 | 7 |
| Polyvinyl alcohol (PVA-117) | 4 | 5 | 4 | 5 |
| Water | 100 | 100 | 100 | 100 |
| Sizing degree | 4 | 6 | 5 | 7 |

TABLE 3

| Evaluation results | (1) | (2) | (3) | (4) | (5) | (6) |
|---|---|---|---|---|---|---|
| Example 6 | 1.2 | O | O | O | O | O |
| Example 7 | 1.2 | O | O | O | O | O |
| Example 8 | 1.2 | O | O | O | O | O |
| Example 9 | 1.2 | O | O | O | O | O |

What is claimed is:

1. A recording paper comprising a fibrous substrate paper on the surface of which a silicon containing type pigment and a fibrous material of the substrate paper are present in a mixed state, said recording paper having a Stöckigt sizing degree ranging from 0 to 15 sec. and a basis weight ranging from 90 to 200 g/m$^2$.

2. A recording paper according to claim 1, wherein the Stöckigt sizing degree is in the range of 0 to 10 sec.

3. A recording paper according to claim 1, wherein the Stöckigt sizing degree is in the range of 0 to 5 sec.

4. A recording paper according to claim 1, wherein the basis weight is in the range of 90 to 160 g/m$^2$.

5. A recording paper according to claim 1, wherein the oil absorption of said silicon containing type pigment according to JIS K 5101 is in the range of 80 to 300 ml/100 g.

6. A recording paper according to claim 1, wherein said silicon containing type pigment is silica, calcium silicate, aluminum silicate or magnesium silicate.

7. A recording paper comprising a fibrous substrate paper on the surface of which a coating liquid containing a silicon containing type pigment and an aqueous binder at a weight ratio of 1/1–3/1 is coated, and on the surface of which a silicon containing type pigment and a fibrous material of the substrate paper are present in a mixed state, said recording paper having a Stöckigt sizing degree ranging from 0 to 15 sec. and a basis weight ranging from 90 to 200 g/m$^2$.

8. A recording paper according to claim 7, wherein the Stöckigt sizing degree is in the range of 0 to 10 sec.

9. A recording paper according to claim 7, wherein the Stöckigt sizing degree is in the range of 0 to 5 sec.

10. A recording paper according to claim 1, wherein the basis weight is in the range of 90 to 150 g/m$^2$.

11. A recording paper according to claim 7, wherein the oil absorption of said silicon containing type pigment according to JIS K 5101 is in the range of 80 to 300 ml/100 g.

12. A recording paper according to claim 7, wherein said silicon containing type pigment is silica, calcium silicate, aluminum silicate or magnesium silicate.

* * * * *

UNITED STATES PATENT AND TRADEMARK OFFICE

CERTIFICATE OF CORRECTION

PATENT NO. : 4,758,461

DATED : July 19, 1988

INVENTOR(S) : TAKASHI AKIYA, ET AL.

It is certified that error appears in the above-identified patent and that said Letters Patent is hereby corrected as shown below:

AT [54] IN THE TITLE

"RECORDING PAPER AND INK JET RECORDING METHOD BY USE THEREOF" should read --INK JET RECORDING PAPER--.

COLUMN 1

Line 2, "RECORDING PAPER AND INK JET RECORDING METHOD BY USE THEREOF" should read --INK JET RECORDING PAPER--.

COLUMN 3

Line 66, "is hydrophilic" should read --is preferably hydrophilic--.

COLUMN 8

Line 29, "x," should read --X,--.
Line 32, "x," should read --X,--.
Line 36, "x," should read --X,--.

UNITED STATES PATENT AND TRADEMARK OFFICE

CERTIFICATE OF CORRECTION

PATENT NO. : 4,758,461

DATED : July 19, 1988

INVENTOR(S) : TAKASHI AKIYA, ET AL.

It is certified that error appears in the above-identified patent and that said Letters Patent is hereby corrected as shown below:

COLUMN 10

Line 27, "claim 1," should read --claim 7,--.
Line 28, "150 g/m$^2$." should read --160 g/m$^2$.--.

Signed and Sealed this

Second Day of May, 1989

*Attest:*

DONALD J. QUIGG

*Attesting Officer*

*Commissioner of Patents and Trademarks*